United States Patent [19]

Adam

[11] Patent Number: 4,653,810

[45] Date of Patent: Mar. 31, 1987

[54] PRE-BOLTING SYSTEM FOR UNDERGROUND MINES

[76] Inventor: Roger F. J. Adam, 1351 Washington Rd., Pittsburgh, Pa. 15228

[21] Appl. No.: 796,191

[22] Filed: Nov. 8, 1985

[51] Int. Cl.[4] ..... E21C 35/04

[52] U.S. Cl. ..... 299/11; 299/17; 299/33; 405/260

[58] Field of Search ..... 299/17, 33, 11; 175/61, 175/78, 79; 405/260

[56] References Cited

U.S. PATENT DOCUMENTS 2,644,669 7/1953 Curtis et al. ..... 175/78
4,062,412 12/1977 McIlvanie ..... 175/78 X
4,084,384 4/1978 Serata ..... 405/260 X

FOREIGN PATENT DOCUMENTS 2805679 8/1978 Fed. Rep. of Germany ..... 175/78

*Primary Examiner*—Stephen J. Novosad
*Assistant Examiner*—Michael Goodwin
*Attorney, Agent, or Firm*—William J. Ruano

[57] ABSTRACT

A pre-bolting system for underground mines which comprises narrow, deep slots in the working face and in drilling through at an angle and bolting from inside these slots with equipment specially designed for this purpose. The drilling, bolting equipment uses high pressure water to assist drilling by water jet. The bit can also be driven by an axial water turbine of small diameter located at the bit. The equipment includes a ventilation system to dilute gas inside the slot when drilling or bolting.

10 Claims, 12 Drawing Figures

PRE-BOLTING SYSTEM FOR UNDERGROUND MINES

This invention relates to a pre-bolting system for underground mines. Reinforcement of roof strata by bolting should be done by setting the bolt immediately at the working face and may require a bolt length greater than the seam height. The optimum solution would be to set the bolts before removing the coal (or other mineral) supporting the roof, and to set a bolt of the appropriate length.

BACKGROUND OF THE INVENTION

Setting bolts longer than the available height is usually done by drilling with extension rods, manually bending the bolt before inserting it in the hole and straightening it when the first half is in the hole.

In order to mechanize these operations, several flexible drill machines have been tested, but the drill rod is flexible only before being submitted to torque and thrust. This means a cumbersome drive is set at the hole orifice.

Machines to bend and insert bolts have also been developed but they are not adapted to resin bolts. The driving head is also complex and cumbersome. Therefore, they would not permit bolting ahead of the working face, which is the key to safety improvement.

SUMMARY OF THE INVENTION

The present invention is a pre-bolting system which consists in cutting narrow and deep slots in the working face in such a manner that drilling and bolting can be done from inside the slot with equipment specially designed for this purpose and answering to narrow space requirements.

DESCRIPTION OF THE PREFERRED EMBODIMENT

Figure 2:
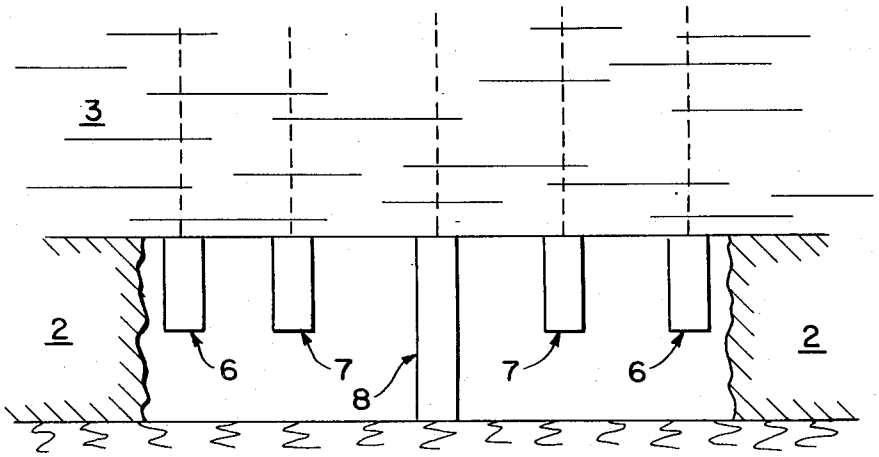
FIG. 2 is a vertical cross-sectional view thereof.
Figure 1:
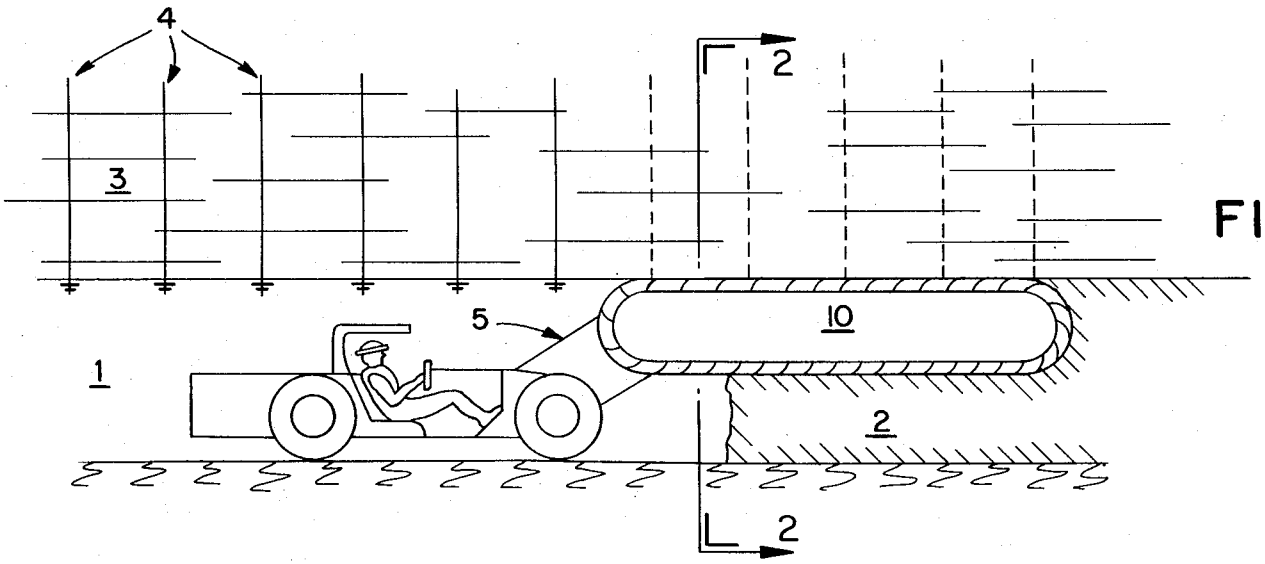
FIG. 1 is an elevational view of a mine entry, partly in section, showing equipment for cutting a slot in the working face in accordance with the present invention.

FIG. 1 shows the mining of an entry 1 in a flat coal seam 2 with the roof 3 being supported by roof bolts 4. A universal cutting machine 5 can be used to cut deep, narrow slots 6, 7, 8, and 9 into the face. The top of the slot is against the roof. The slot is generally perpendicular to the roof and, in any case, can be oriented to permit drilling and bolting according to the selected bolting pattern. The slot width needs only to be about 6 to 10 inches wide. Such a slot will not alter the roof support provided by the material in place.The slot length is limited by technology to about 10 feet, which is the length of the cutting arm 10 on the cutting machine. In conventional mining, these slots will take all the seam height, as represented by slot 8, and be used as a blasting cut.

Figure 2A:
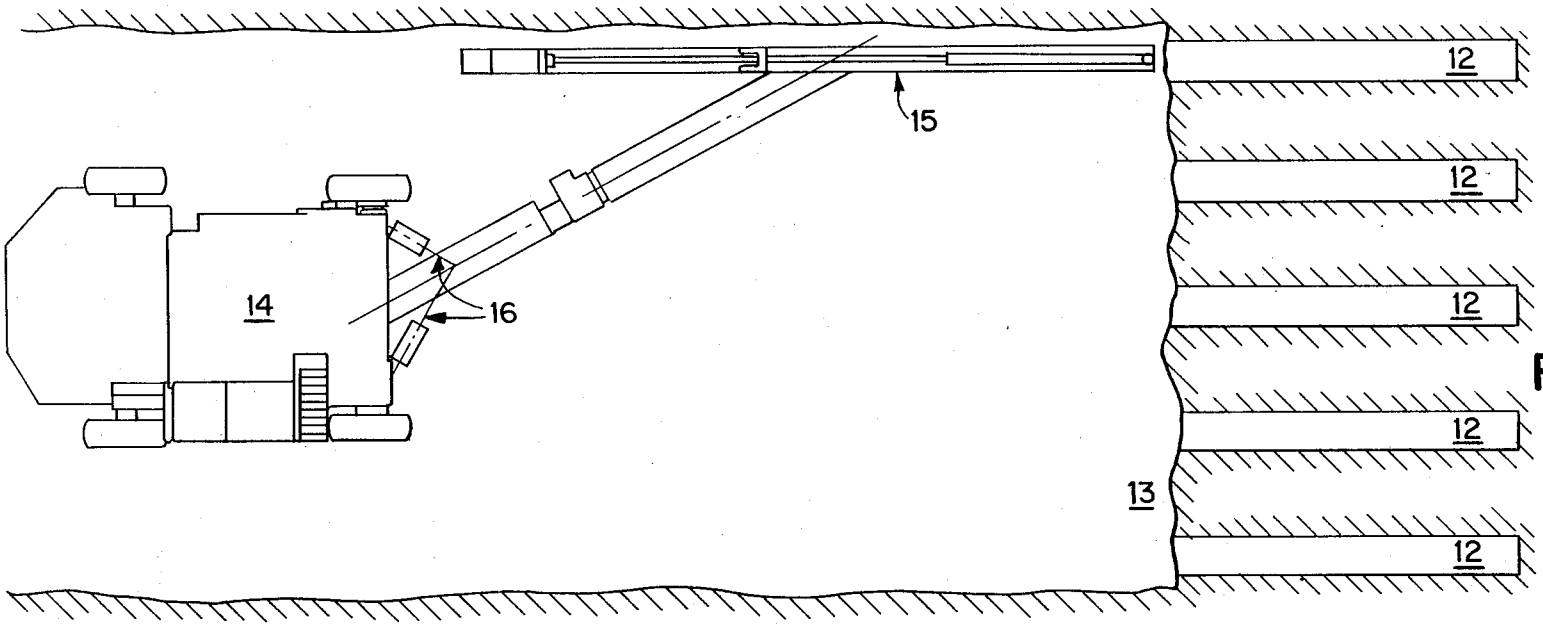
FIGS. 2*a* and 2*b* are top and elevational views, respectively, showing the drilling equipment of the present invention.
Figure 2B:
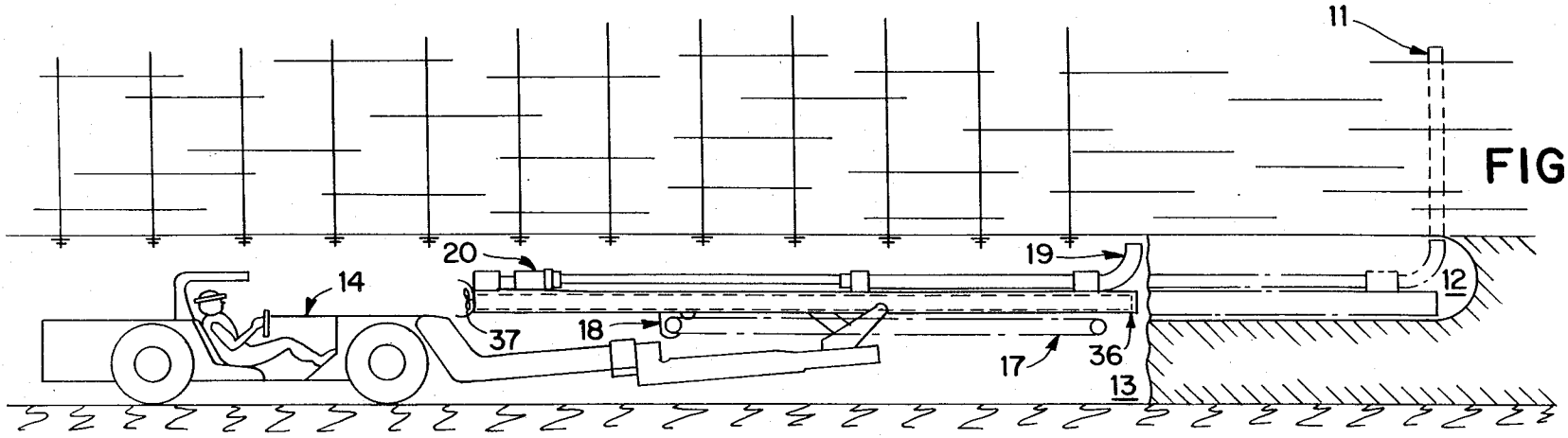

FIGS. 2*a* and 2*b* show a top view 2*a* and side view 2*b* of an entry with a machine drilling a hole 11 inside the slot 12 ahead of the face 13 with specially designed equipment using curved drilling. The drilling machine 14 is automotive, preferably equipped with rubber tires. The drilling arm 15 can be placed in front of the slot by using swing and orientating jacks 16. Then the drilling arm can be inserted into the hole by using an advancing device represented here an an endless chain 17 and a motor drive 18. The face end of the drilling arm is equipped with a curved guide 19 to bend the flexible drill rod at 90°. This allows the bolt hole to be drilled perpendicular to the entry axis.

The difference between this method and an existing flexible drill, is that the guide 19 does not transmit torque or thrust and, therefore, can be easily inserted into a narrow slot. The power required for drilling is transmitted to the drilling bit from two preferred locations. One is the rear end of the flexible drill or shaft 20, and the other is at the cutting bit itself inside the hole 11. The use of water jet assisted cutting, in which high pressure water jets on the cutting bits reduces the required values of thrust and torque, compared to the values required for drilling in a conventional manner, effects a greater reduction in specific energy. The force reduction due to water jet assistance permits the economic use of a flexible drill rod.

FIG. 3 represents, in more detail, the conceptual design of a flexible drill rod according to the present invention. FIG. 3*a* represents a flexible drill rod which consists of three sections; the cutting end 21 which is rigid to provide guidance to the bit; a flexible part in the middle 22 which has a length approximately equal to the length of the hole to be drilled; and a rigid part 23.

The flexible part is always guided inside a guide 24 curved at its end 19 or inside the hole itself 25. The third part 23, is rigid to facilitate the advance of the cutting bit without needing guidance itself. If this part of the drill rod is not rigid, it would require a telescopic guide. The length of the rigid part is approximately equal to the drilling depth.

Figure 3A:
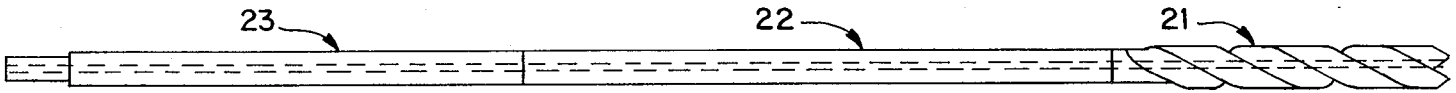
FIGS. 3*a* and 3*b* are enlarged views of the drill rod of the present invention shown in different positions.
Figure 3B:
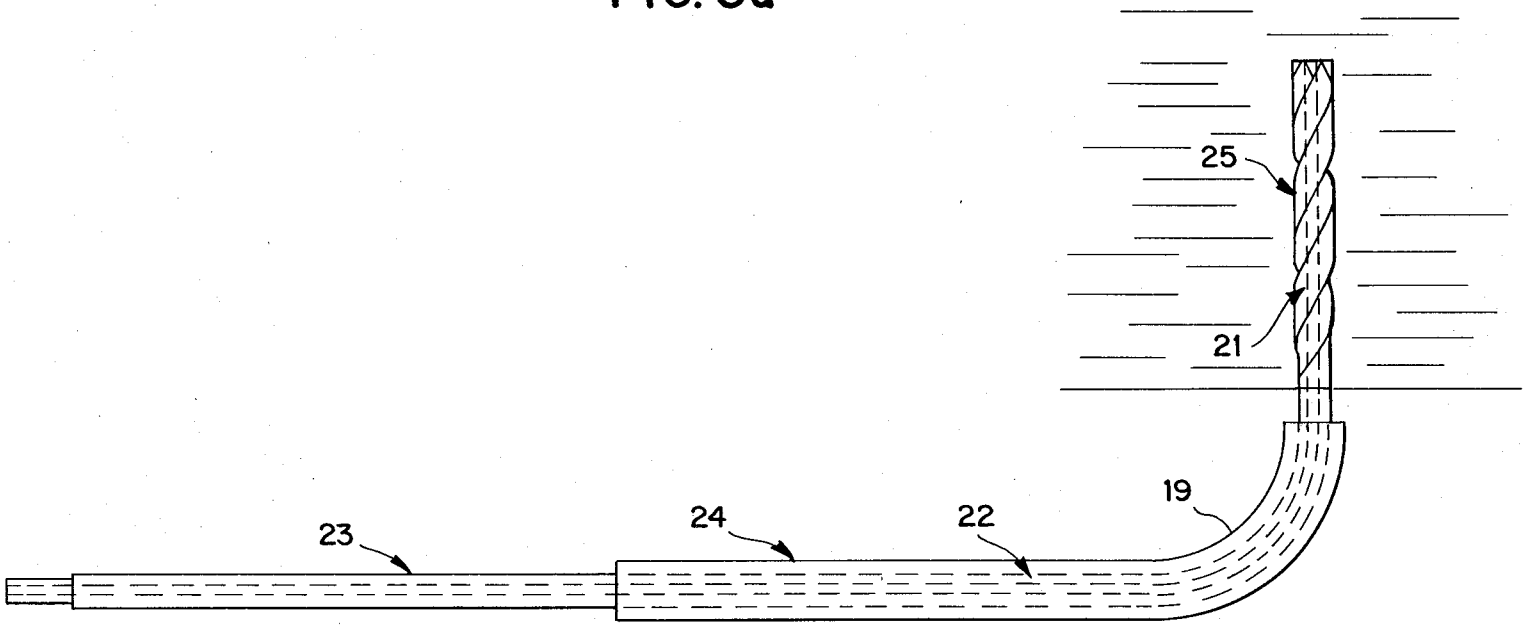
Figure 3C:
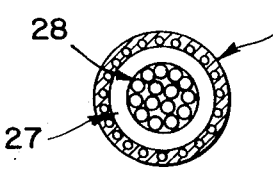
FIGS. 3*c* and 3*d* are sectional views thereof.
Figure 3D:
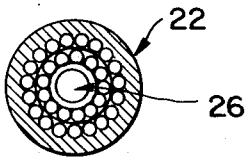

In order to supply high pressure water to the bit for water jet assist cutting, the rigid parts of the drill rod 21, 23 are hollow and are used as a pipe for the water supply. As illustrated in FIG. 3*d*, the flexible part 22 may have a hollow core 26 connected to the central hole of the rigid parts, or it may have an annular space 27 (FIG. 3*c*) between a central core 28, similar to a flexible shaft, and a casing 29, similar to a high pressure hose.

Figure 4A:
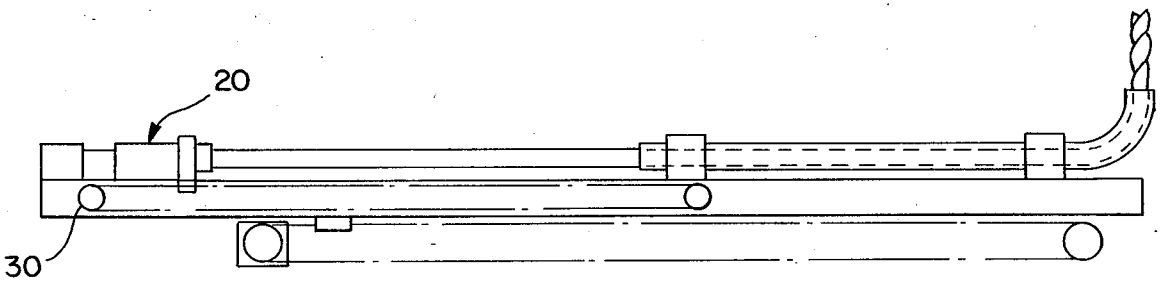
FIGS. 4, 4*a* and 4*b* are elevational views showing how torque and thrust is applied angularly to the cutting bit.
Figure 4:
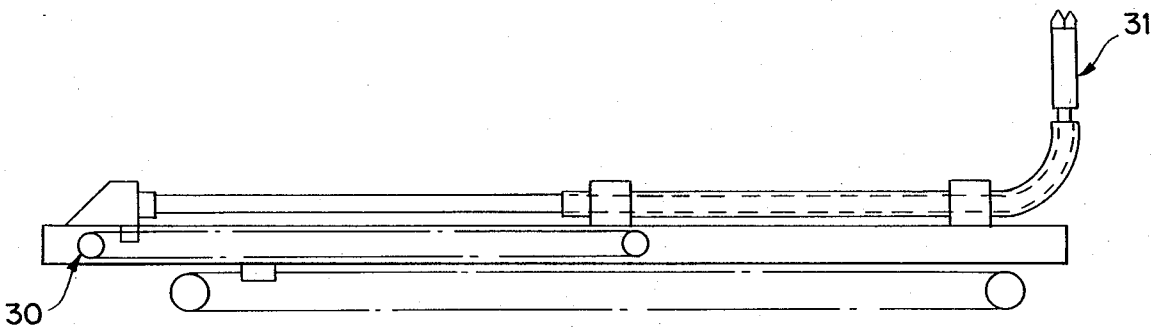
Figure 4B:
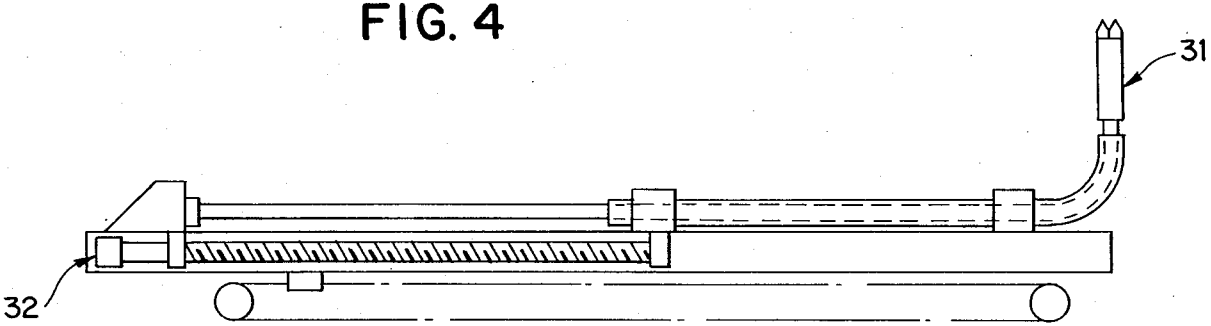

FIGS. 4, 4*a*, and 4*b* illustrate two ways of supplying torque and thrust angularly to the cutting bit.

FIG. 4*a* represents a flexible drill rod driven from the outer side by a rotary drill and advanced by a endless chain system 30.

FIGS. 4 and 4*b* represent a flexible drill rod equipped with a water turbine 31 driving the cutting bit. The rod is transmitting only thrust and providing resistant torque. The rotary drill is suppressed, but the thrust is provided by a similar endless chain advance system 20, as in FIG. 4, or a screw 32 as in FIG. 4*b*.

When using a water-powered cutting bit, the flow of high pressure water is driving a small diameter axial turbine. The water is then ejected through orifices with a water pressure still sufficient to assist the cutting action of the bit.

Figure 5:
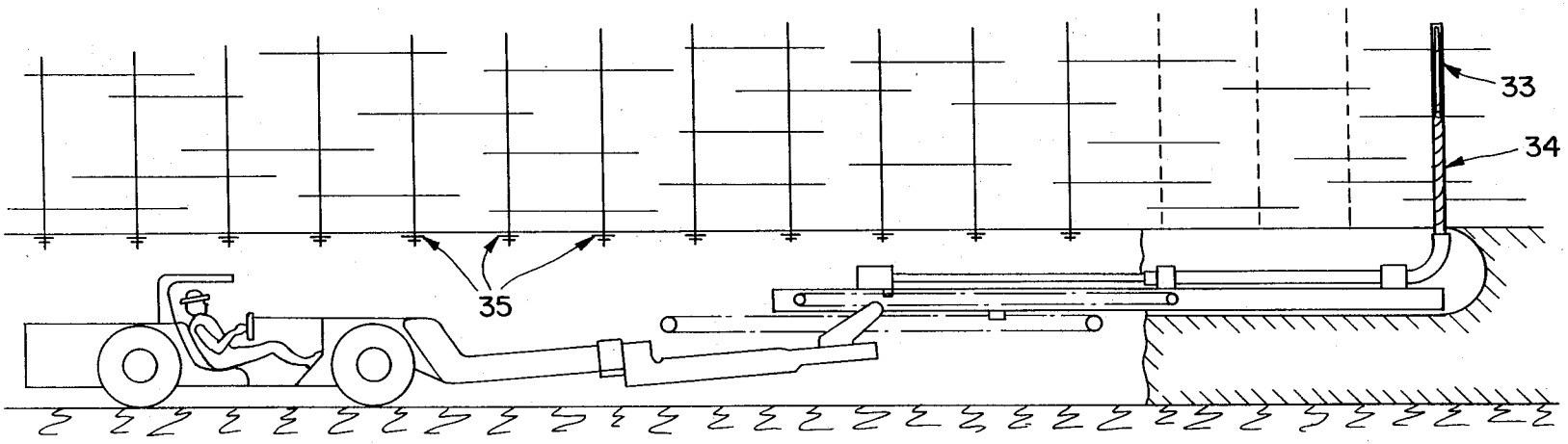
FIG. 5 is an elevational view showing how a bolt can be inserted in a hole inside the slot prior to mining.

FIG. 5 represents how a bolt can be inserted in a hole inside the slot prior to mining. The device to insert a bolt is similar to the drilling arm. The bolting arm is equipped with a curved guide identical in its shape to the guide used for drilling and requires a rotary drill. The same arm could be used for both functions. Resin cartridges 33 are placed at the entrance of the guide and pushed inside the hole 34 by the flexible bolt. The flexible bolt is pushed by a chainless advance system and rotated by a rotary drill. The system will not allow use of end plates 35 at the time the bolt is set, but a threaded part on the bolt will allow installation of plates later when mining the coal. This will also allow for the setting of steel beams or mesh when mining.

Drilling and bolting inside a slot cut in the working face may require ventilation of the slot to prevent gas accumulation. FIG. 2*b* shows the location of auxiliary piping 36 and a little fan 37. As represented, the ventilation pipe is used as a support for the drilling and bolting arm.

While I have illustrated and described several embodiments of my invention, it will be understood that these are by way of illustration only and that various changes and modifications may be contemplated in my invention and within the scope of the following claims.

I claim:

1. In an underground mine having an entry and having a working face below roof strata, the method of prebolting said roof strata for reinforcement thereof before mining comprising cutting deep narrow vertical slots into said working face just below the roof strata to be reinforced, inserting a drilling tool and flexible drilling rod into each of said slots to drill a hole at right angles to, and upwardly of the roof strata and finally, removing said drilling tools and bolting the drilled holes through said slots.

2. The method recited in claim 1 wherein high pressure water is fed through said flexible rod and drilling tool to provide water jet-assistance during drilling.

3. The method recited in claim 2 wherein said high pressure water is conducted through an annular space of the flexible drilling rod.

4. The method recited in claim 2 wherein said high pressure water is conducted through an axial space in the flexible drilling rod.

5. The method recited in claim 2 wherein the drilling tool is driven by a small diameter axial turbine powered by said high pressure water under a pressure sufficient to drive said turbine and still assist the cutting action of the tool, said turbine being located immediately behind said drilling tool.

6. The method recited in claim 1 wherein said drilling rod is rigidly guided by a guide having a straight part as long as the drill hole length and ending with a 90° bend, said drilling rod being made of a flexible part capable of advancing through a 90° bend and of a rigid part driving and pushing the flexible part into the said guide up to the 90° bend.

7. The method recited in claim 1 wherein ventilating air is blown into each of said slots while drilling and bolting.

8. The method recited in claim 1 wherein bolting of said drilled hole is effected by inserting an "L"-shaped tubular guide into said slot, passing a flexible bolt through said guide and into said drilled hole and applying rotary drive to the outer end of said bolt using a flexible extension.

9. The method recited in claim 1 wherein said drilling tool and flexible drilling rod, together with a support and guide, are introduced and positioned into said slot by an endless chain conveyor.

10. The method as recited in claim 9 wherein said support includes a blowing ventilating system.

* * * * *